US009799962B2

(12) United States Patent
Lee et al.

(10) Patent No.: US 9,799,962 B2
(45) Date of Patent: Oct. 24, 2017

(54) DUAL-POLARIZED DIPOLE ANTENNA

(71) Applicant: Electronics and Telecommunications Research Institute, Daejeon (KR)

(72) Inventors: Jung Nam Lee, Daejeon (KR); Kwangchun Lee, Daejeon (KR); Gweon Do Jo, Daejeon (KR); Heon Kook Kwon, Daejeon (KR); Byung Su Kang, Daejeon (KR); Jung Hoon Oh, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 285 days.

(21) Appl. No.: 14/518,714

(22) Filed: Oct. 20, 2014

(65) Prior Publication Data

US 2015/0214634 A1 Jul. 30, 2015

(30) Foreign Application Priority Data

Jan. 28, 2014 (KR) ..... 10-2014-0010204

(51) Int. Cl.
*H01Q 21/26* (2006.01)
*H01Q 9/06* (2006.01)
*H01Q 1/24* (2006.01)

(52) U.S. Cl.
CPC ..... *H01Q 21/26* (2013.01); *H01Q 9/065* (2013.01); *H01Q 1/246* (2013.01)

(58) Field of Classification Search
CPC ..... H01Q 21/26; H01Q 9/065; H01Q 1/246; H01L 2924/3025; H01L 2224/131; H05K 1/181; H05K 2201/10371; H05K 9/0024; H05K 2201/0707
USPC ..... 343/797; 361/800, 816, 818; 174/350, 174/356, 377, 386, 388
See application file for complete search history.

(56) References Cited

U.S. PATENT DOCUMENTS 6,072,439 A 6/2000 Ippolito et al.
8,081,062 B2 12/2011 Son et al.
(Continued)

OTHER PUBLICATIONS

Wu, Bi Qun, et al., "A broadband dual-polarized magneto-electric dipole antenna with simple feeds." Antennas and Wireless Propagation Letters, IEEE 8 (2009): 60-63.
(Continued)

*Primary Examiner* — Dameon E Levi
*Assistant Examiner* — David Lotter
(74) *Attorney, Agent, or Firm* — NSIP Law

(57) ABSTRACT

Provided is a dual-polarized dipole antenna. The dual-polarized dipole antenna includes a substrate etched as first and second microstrip lines and provided in a cube, first to fourth feeding lines etched as third microstrip lines and disposed in a square type in a vertical direction to the substrate, and first to fourth radiation patches disposed in a square type in the vertical direction to the first to fourth feeding unit, wherein the first to fourth feeding units are respectively disposed on adjacent pairs of the first to fourth radiation patches. According to the present invention, a miniature dual-polarized dipole antenna having a wide bandwidth, high isolation characteristics, and a high gain can be provided.

16 Claims, 5 Drawing Sheets

(56) References Cited

U.S. PATENT DOCUMENTS

| | | | | |
|---|---|---|---|---|
| 8,354,972 | B2 * | 1/2013 | Borja | H01Q 1/38 343/700 MS |
| 2011/0316755 | A1 * | 12/2011 | Ayatollahi | H01Q 9/28 343/793 |
| 2012/0313821 | A1 * | 12/2012 | Fischer | H01Q 9/0407 343/700 MS |

OTHER PUBLICATIONS

Siu, Lam, et al., "A dual-polarized magneto-electric dipole with dielectric loading." Antennas and Propagation, IEEE Transactions on 57.3 (2009): 616-623.

* cited by examiner

DUAL-POLARIZED DIPOLE ANTENNA

CROSS-REFERENCE TO RELATED APPLICATIONS

This U.S. non-provisional patent application claims priority under 35 U.S.C. §119 of Korean Patent Application No. 10-2014-0010204, filed on Jan. 28, 2014, the entire contents of which are hereby incorporated by reference.

BACKGROUND OF THE INVENTION

The present invention disclosed herein relates to a dual-polarized dipole antenna including a plurality of dipole antennas generating dual-polarized waves.

Mobile communication has been developed from a first generation advanced mobile phone system (AMPS), by way of digital communication and 3rd generation communication capable of transmitting large capacity data, to 4th generation communication capable of accessing a wide band communication network. As a service provider provides various mobile communication services including 2G, 3G, and long term evolution (LTE), etc., an antenna of a mobile communication base station becomes bandwidth-enhanced and miniaturized. In particular, in 4th generation mobile communication typified by a worldwide interoperability for microwave access (WiMAX) and LTE, a remote radio head (RRH) technology, which is a next generation transmitter and receiver, is expected to be widely used.

Typically, an antenna performs a role of radiating an electromagnetic wave to the outside or receiving an electromagnetic wave from the outside in wireless communication. In detail, an antenna performs a role of converting an electrical signal input from a feed line into an electromagnetic wave and radiating the electromagnetic wave to the outside, and receiving an electromagnetic wave from the outside through half wavelength resonance, converting the electromagnetic wave into an electric signal and delivering the electric signal to the feed line.

There are various antennas according to operating method and specification thereof. Among them, a dipole antenna is an antenna symmetrically distributing electric field lines around a central axis, when an AC current is applied to an open microstrip line.

Such a dipole antenna is mainly used in a base station for a mobile communication system and implemented in various types. In particular, a dual-polarized antenna has a square dipole structure in which two pairs of dipole antennas are symmetrically arrayed, or a cross dipole structure in which two dipole antennas are extended in straight lines and arrayed to cross each other. The dipole antenna pairs may be arrayed orthogonally to each other and used for transmitting and receiving two polarized signals.

Core technology of a miniature mobile communication base station antenna lies is in miniaturization by embedding a RF portion and an antenna in a small cube. In order to increase channel capacity, a dual-polarized antenna may be used by using an electric/magnetic field, and, when the antenna is inserted into the cube, boundary surface conditions may be changed such that antenna characteristics may be changed. As the result, antenna bandwidth and gain may be reduced. Accordingly, manufacturing a miniature mobile communication base station antenna having a wide bandwidth, high isolation characteristics, and a high gain is emerged as an important issue.

SUMMARY OF THE INVENTION

The present invention provides a miniature dual-polarized dipole antenna having a wide bandwidth, high isolation characteristics, and a high gain.

Embodiments of the present invention provide dual-polarized dipole antennas including: a substrate etched as first and second microstrip lines and provided in a cube; first to fourth feeding lines etched as third microstrip lines and disposed in a square type in a vertical direction to the substrate; and first to fourth radiation patches disposed in a square type in the vertical direction to the first to fourth feeding unit, wherein the first to fourth feeding units are respectively disposed on adjacent pairs of the first to fourth radiation patches.

In some embodiments, the first micros trip line may be etched from the first feed to a first feed point and to a third feed point opposite to the first feed point, and the second microstrip line may be etched from the second feed to a second feed point and to a fourth feed point opposite to the second feed point.

In other embodiments, the third microstrip lines etched in the first to fourth feeding units may be respectively connected to the first to fourth feed points.

In still other embodiments, each of the first to fourth feeding units may have an open loop type having an opening allowing the first microstrip line or the second microstrip line to be passed, and the opening faces the substrate.

In even other embodiments, the third microstrip lines may have an open loop type having the opening faced the substrate and be etched to allow an opposite end of a portion at which the third microstrip lines contact to the first to fourth feeding points not to abut onto the substrate.

In yet other embodiments, distances from the first feed to the first feed point, from the first feed to the third feed point, from the second feed to the second feed point, and from the second feed to the fourth feed point may be identical.

In further embodiments, a degree of matching may be determined according to a length of the third microstrip lines.

In still further embodiments, the dual-polarized dipole antenna may further include a plurality of metal short-circuit plates provided to both sides of each of the first to fourth feeding units in vertical direction to the substrate.

In even further embodiments, each of the metal short-circuit plates may be connected to a ground surface disposed between the substrate and the cube through via holes formed in the substrate.

In yet further embodiments, the first and second feeds may be connected to subminiature version A (SMA) connectors through the via holes formed in the substrate.

In much further embodiments, the first to fourth feeding units and the first to fourth radiation patches may be disposed separate by a predetermined distance from each other.

In still much further embodiments, the first to fourth radiation patches may be a quadrilateral or circular type.

In even much further embodiments, the cube may be a metal body of aluminum, copper, or the like.

In yet much further embodiments, the cube may be a non-metal body of polycarbonate, acetal, plastic, silicon, Teflon, or the like.

In still even much further embodiments, one side of the cube, which abuts onto the substrate, may be a square whose one side length is a half or smaller than a wavelength corresponding to an operating frequency.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
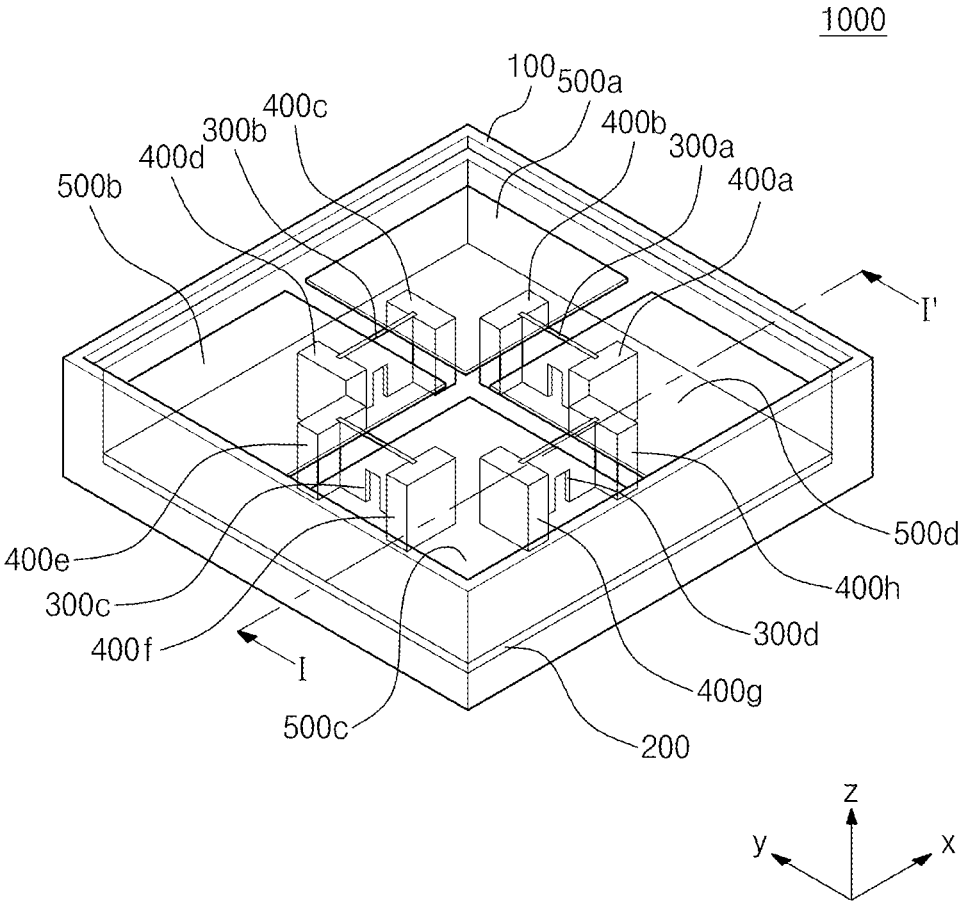
FIG. 1 illustrates a dual-polarized dipole antenna according to an embodiment of the present invention.

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

It should be construed that foregoing general illustrations and following detailed descriptions are exemplified and an additional explanation of claimed inventions is provided. Reference numerals are indicated in detail in embodiments of the present invention, and their examples are represented in reference drawings. In every possible case, like reference numerals are used for referring to the same or similar elements in the description and drawings.

Below, a dual-polarized dipole antenna is used as one example of an electrical device for illustrating characteristics and functions of example embodiments. However, those skilled in the art can easily understand other advantages and performances of example embodiments according to the descriptions. Moreover, example embodiments may be implemented or applied through other embodiments. Besides, the detailed description may be amended or modified according to viewpoints and applications, not being out of the scope, technical idea and other objects of example embodiments.

It will be understood that, although the terms first, second, etc. may be used herein to describe various elements, these elements should not be limited by these terms. These terms are only used to distinguish one element from another. It will be further understood that the terms "comprises", "comprising,", "includes" and/or "including", when used herein, specify the presence of stated features, steps, operations, elements, and/or components, but do not preclude the presence or addition of one or more other features, steps, operations, elements, components, and/or groups thereof. It will also be understood that when a layer (or film) is referred to as being 'on/under' another layer, it can be directly on/under the other layer, or intervening layers may also be present. It will be understood that when an element is referred to as being "connected", "coupled", or "adjacent" to another element, it may be directly connected, coupled or adjacent to the other element or intervening elements or layers may be present.

Hereinafter, it will be described about an exemplary embodiment of the present invention in conjunction with the accompanying drawings.

FIG. 1 illustrates a dual-polarized dipole antenna according to an embodiment of the present invention. Referring to FIG. 1, the dual-polarized dipole antenna 1000 may include a cube 100, a substrate 200, first to fourth feeding unit 300*a* to 300*d*, first to eighth metal short-circuit plates 400*a* to 400*h*, and first to fourth radiation patches 500*a* to 500*d*.

The cube 100 is provided. The cube 100 may be provided in a cavity type configured to entirely enclose two pairs of dipole antennas, for example, including a single feeding unit 300*a*, two metal short-circuit plates 400*a* and 400*b*, and two radiation patches 500*a* and 500*d*.

The cube 100 may be designed to be formed from different materials according to an operating frequency. For example, the cube 100 may be made from a metal material when used in an operating frequency of about 800 MHz or greater, and from a non-metal material when used in an operating frequency of about 400 to about 800 MHz. The cube 100 may be formed from a metal material of Cu, Al or the like, or a non-metal material of polycarbonate, acetal, plastic, silicon, Teflon, or the like.

The cube 100 may have the side length designed according to the operating frequency. For example, when the cube 100 is a square type, the one side length thereof may be a half of an operating wavelength λ corresponding to the operating frequency. However, the one side length may be a quarter of the operating wavelength according to an embodiment, and is not limited hereto. In addition, the cube 100 may be manufactured as a circular type. In this case, it may be well understood that the diameter of the cube may be a half or a quarter of an operating wavelength λ corresponding to the operating frequency, but is not limited hereto.

The substrate 200 is provided inside the cube 100. For example, the substrate 200 may be made from a dielectric material. First and second microstrip lines 220 and 240 (see FIG. 2) may be provided on the substrate 200. The first and second microstrip lines may be connected to third microstrip lines 310*a* to 310*d* (see FIG. 2) etched in the feeding units 300*a* to 300*d* and deliver signals.

The feeding units 300*a* to 300*d* are provided on the substrate 200. The first to fourth feeding units 300*a* to 300*d* are provided in a vertical direction to the substrate 200. The third microstrip lines 310*a* to 310*d* (see FIG. 2) are etched on one side of each of the feeding units which are formed from a dielectric material. The microstrip lines 310*a* and 310*c* (see FIG. 2) on the first and third feeding units 300*a* and 300*c* may be connected to the first microstrip line 220 (see FIG. 2), and the microstrip lines 310*b* and 310*d* (see FIG. 2) on the second and fourth feeding units 300*b* and 300*d* are connected to the second microstrip line 240 (see FIG. 2).

The metal short-circuit plates 400*a* to 400*h* are provided. Two metal short-circuit plates may be provided to each of the feeding units 300*a* to 300*d*. The first to eighth metal short-circuit plates 400*a* to 400*h* are provided to both sides of the feeding units 300*a* to 300*d* in a vertical direction to the substrate 200. Here, they are provided to two sides except the side etched as the third micros trip lines 310 to 310*d* (see FIG. 2) and the opposite side thereof. The first to eighth metal short-circuit plates 400*a* to 400*h* are grounded and form the two pairs of dipole antennas together with the feeding units 300*a* to 300*d* and the radiation patches 500*a* to 500*d*. In addition, the metal short-circuit plates 400*a* to 400*h* may play a role of supporting the feeding units 300*a* to 300*d*.

The radiation patches 500*a* to 500*d* are provided on the feeding units 300*a* to 300*d* and the metal short-circuit plates 400*a* to 400*h*. The radiation patches 500*a* to 500*d* are media through which electromagnetic waves are transmitted and received and may be formed from a metal material such as Cu. Each of the first to fourth radiation patches 500*a* to 500*d* is disposed contacting to the two feeding units and two metal short-circuit plates (i.e. contacting feed) or disposed separate by a certain distance (i.e. non-contacting feed).

A radome 600 (see FIG. 4) is provided on the radiation patches 500*a* to 500*d*. The radome 600 is provided to protect the two pairs of dipole antennas and may be made from an isolator.

The dual-polarized dipole antenna 1000 may include 4 dipole antennas and each of the dipole antennas may include one feeding unit, e.g., 300*a*, two metal shot-circuit plates, e.g., 400*a* and 400*b*, and two radiation patches, e.g., 500*a* and 500*d*. When the dual-polarized dipole antenna 1000 is operated as a transmitter, a signal delivered through the first to third microstrip lines may be radiated externally in an electromagnetic wave type through the dipole antennas. When the dual-polarized dipole antenna 1000 is operated as a receiver, the dipole antenna receives an electromagnetic wave, and the received electromagnetic wave may be delivered through a microstrip line (not shown) in an electrical signal type.

According to an embodiment of the present invention, two pairs of dipole antennas may be prepared, each pair of which generate vertically and horizontally polarized waves for generating dual-polarized waves. For example, an antenna (hereinafter referred to as a first dipole antenna) including a first feeding unit 300*a*, first and second metal short-circuit plates 400*a* and 400*b*, and first and fourth radiation patches 500*a* and 500*d*, and an antenna (hereinafter referred to as a third dipole antenna) including the third feeding unit 300*c*, fifth and sixth metal short-circuit plates 400*e* and 400*f*, and second and third radiation patches 500*b* and 500*c* may generate the horizontally polarized wave. Furthermore, an antenna (hereinafter referred to as a second dipole antenna) including a second feeding unit 300*b*, third and fourth metal short-circuit plates 400*c* and 400*d*, and first and second radiation patches 500*a* and 500*b*, and an antenna (hereinafter referred to as a fourth dipole antenna) including the fourth feeding unit 300*d*, seventh and eighth metal short-circuit plates 400*g* and 400*h*, and third and fourth radiation patches 500*c* and 500*d* may generate the vertically polarized wave. This is a structure in which the radiation patches 500*a* to 500*d* are shared to generate the dual-polarized waves, which results in miniaturization and a higher antenna gain than that of an existing monopole antenna. In addition, despite of a small size thereof, wider bandwidth may be obtained and isolation may be increased.

Figure 2:
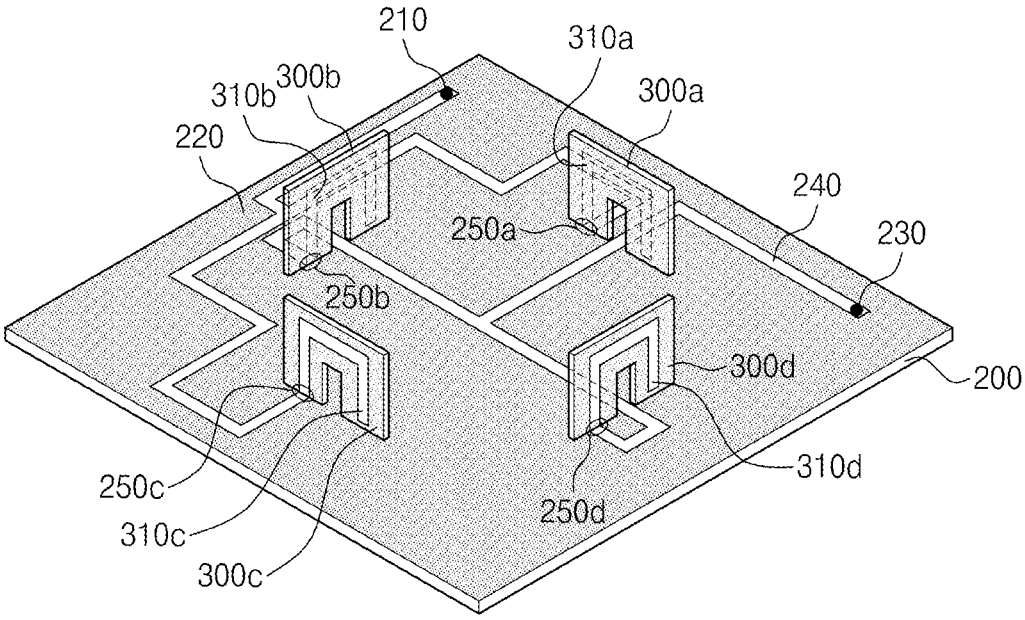
FIG. 2 illustrates a substrate according to an embodiment of the present invention.

FIG. 2 illustrates a substrate according to embodiment of the present invention. The substrate 200 may be formed from a dielectric material. In addition, the substrate 200 may play a role of a reflection surface supporting the dipole antennas and reflecting an electromagnetic wave to be transmitted and a received electromagnetic wave.

The first and second feeds 210 and 230 are provided on the substrate 200. They allow two signals for generating a dual-polarized wave to be applied.

The first and second microstrip lines 220 and 240 are provided in an orthogonal type without being mutually overlapped. Here, the lengths of the first and second microstrip lines 220 and 240 may be identical. In addition, the length of the microstrip line from the first feed 210 to a feed point 250*a*, the length of the microstrip line from the first feed 210 to a feed point 250*c*, the length of the microstrip line from the second feed 230 to a feed point 250*b*, and the length of the microstrip line from the second feed 230 to a feed point 250*d* are necessary to be identical. These are for inducing matching when the dipole polarized wave is generated.

The first to fourth feeding units 300*a* to 300*d* are provided. Each of the feeding units 300*a* to 300*d* may be formed from a dielectric material and have an open-loop having an opening at a portion abutting onto the substrate 220 to allow the first and second microstrip lines 220 and 240 to be passed. The third microstrip lines 310*a* and 310*b* (see FIG. 2) respectively provided to the first and third feeding units 300*a* and 300*c* are connected to the first microstrip line 220 through the feed points 250*a* and 250*c*. The second microstrip line 240 is connected to the third microstrip lines 310*b* and 310*d* (see FIG. 2) respectively provided to the second and fourth feeding units 300*b* and 300*d* through the feed points 250*b* and 250*d*.

A signal applied from the first feed 210 is delivered to the two dipole antenna (namely, the first and third dipole antennas) through the first microstrip line 220, and the first and third feeding unit 300*a* and 300*c*, and then radiated externally. Similarly, a signal applied from the second feed 230 is delivered to the two dipole antennas (namely, the second and fourth dipole antenna) through the second microstrip line 240, and the second and fourth feeding units 300*b* and 300*d*, and then radiated externally.

According to an embodiment of the present invention, each dipole antenna is configured to be orthogonal to each other and forms dual-polarized waves. In addition, despite of a small size antenna, a wider bandwidth may be obtained and isolation may be increased.

Figure 3:
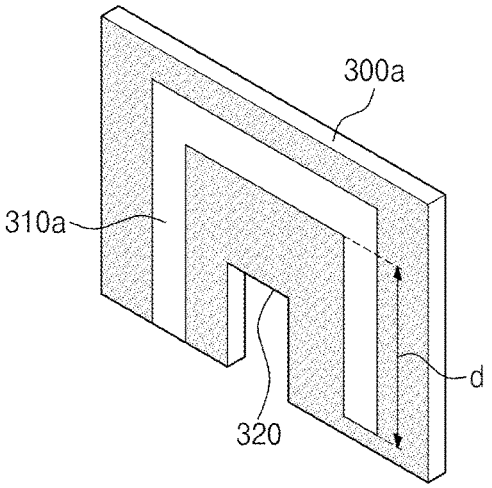
FIG. 3 illustrates a feeding unit according to an embodiment of the present invention.

FIG. 3 illustrates a feeding unit according to an embodiment of the present invention. Although the first feeding unit 300*a* is exemplarily illustrated, the first to fourth feeding units 300*a* to 300*d* have an identical structure. The first feeding unit 300*a* and the third micros trip line 310*a* may have an open-loop type in which a portion abutting onto the substrate 200 (see FIG. 2) has an opening 320. This is for allowing the first or second microstrip line 220 or 240 (see FIG. 2) to be passed. Although the quadrilateral type opening 320 is illustrated in the drawing, it is obvious that various types of the opening such as a curved type or a circular type are available.

An operating frequency may be varied by varying the length d of the third microstrip line 310*a* and a degree of antenna matching may be adjusted. Detailed description about this will be provided with reference to a graph shown in FIG. 7.

Figure 4:
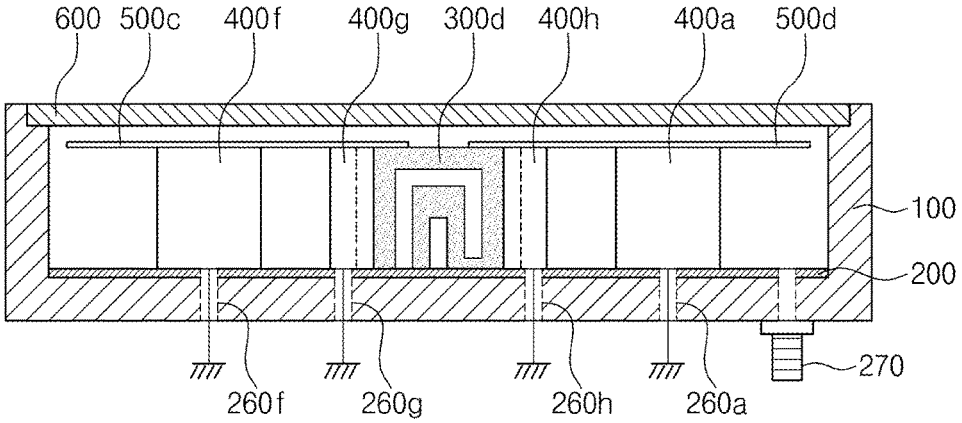
FIG. 4 is a cross-sectional view taken along a line I-I' of FIG. 1.

FIG. 4 is a cross-sectional view taken along a line of I-I' in FIG. 1. FIG. 4 illustrates a structure that the cube 100 and the radome 600 enclose four dipole antennas. In addition, although, in the drawing, the radiation patches 500*a* and 500*d* are contacting to the feeding unit 300*d* and the metal short-circuit plates 400*a*, 400*f* and 400*h* (contacting feeding), it is obvious that they are separated by a predetermined distance and dual-polarized waves may be generated in a non-contacting feeding scheme.

Via holes 260*a* to 260*h* are provided. The via holes may be formed at portions where the cube 100 and the substrate 200 contact to each other. Although only four via holes are illustrated, one at a bottom portion of each of the metal short-circuit plates 400*a* to 400*h* (see FIG. 2), total 8 via holes are provided. The via holes are for generating dual-polarized waves by grounding each metal short-circuit plate. In the drawing, the via holes are formed by penetrating through the cube 100 and the substrate 200, but this exemplarily shows that the metal short-circuit plates 400*a* to 400*h* (see FIG. 2) are grounded. According to embodiments, a ground surface (not shown) may be provided between the cube 100 and the substrate 200, or the via holes may be provided by penetrating through the substrate 200. In addition, the metal short-circuit plates 400*a* to 400*h* (see FIG. 2) may be connected to the ground surface through the via holes.

A subminiature version A (SMA) connector 270 is provided. Although one SMA connector is illustrated in the drawing, two SMA connectors may be provided to deliver signals to the first and second feeds 210 and 230 (see FIG. 2), respectively. Referring to FIG. 3, the SMA connector 270 delivers a signal to the second feed 230 (see FIG. 2). The remaining SMA connector not shown in the drawing may deliver a signal to the first feed 210 (see FIG. 1).

Figure 5:
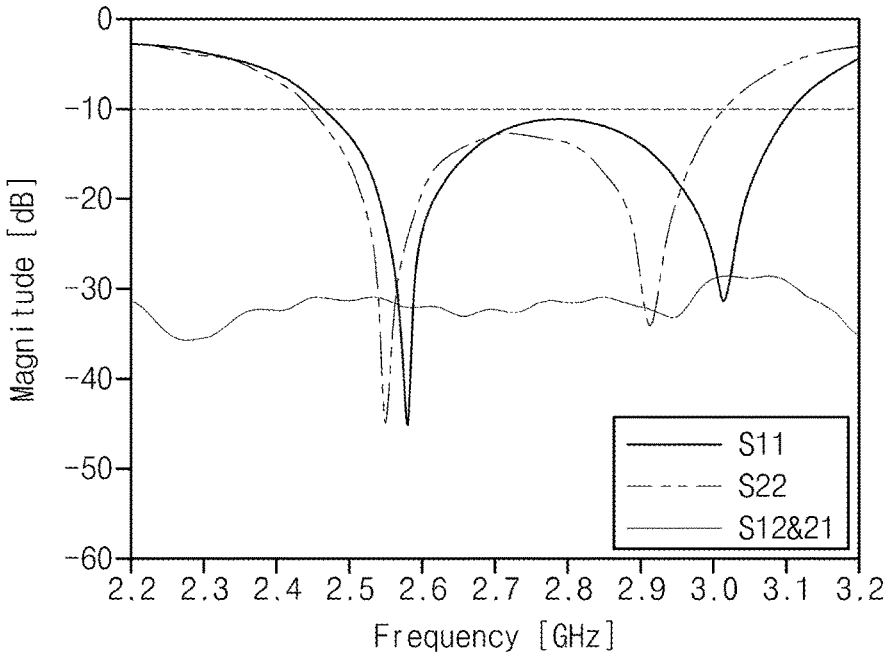
FIG. 5 is a graph showing reflection loss and isolation characteristics of a dual-polarized dipole antenna according to an embodiment of the present invention.

FIG. 5 is a graph showing reflection loss and isolation characteristics of a dual-polarized dipole antenna according to an embodiment of the present invention. Referring to FIG. 5, a band of operation frequency is approximately 2.45 to 3.10 GHz, showing wideband characteristics of about 650 MHz. In addition, it may be known that frequencies radiated based on signals delivered through the first and second feed 210 and 230 (see FIG. 2) are approximately matched. The dipole antennas have very excellent isolation characteristics of about −30 dB or smaller in average.

Figure 6:
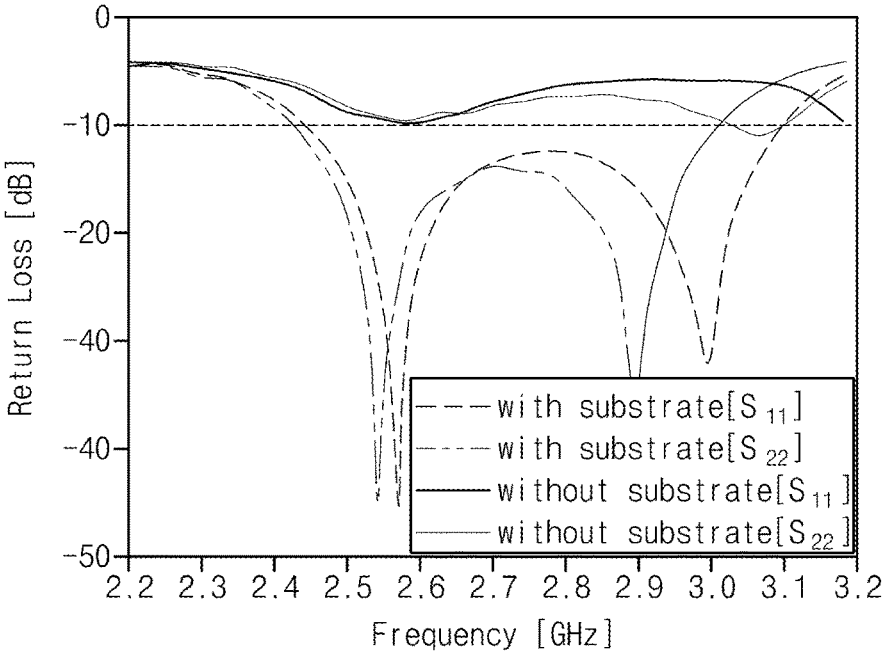
FIG. 6 is a graph showing reflection loss characteristics according to presence of a dielectric material in a feeding unit in a dual-polarized dipole antenna according to an embodiment of the present invention.

FIG. 6 is a graph showing reflection loss characteristics according to presence of the dielectric material in the feeding unit in a dual-polarized dipole antenna according to an embodiment of the present invention. When the dielectric material is removed from the dielectric feeding units 300*a* to 300*d* (see FIG. 2) and only the microstrip lines of the metal material is present, it is shown that the dipole antennas do not match with each other. Accordingly, the degree of antenna matching may be determined by the presence of the dielectric material in the feeding unit or the permittivity of the dielectric material.

Figure 7:
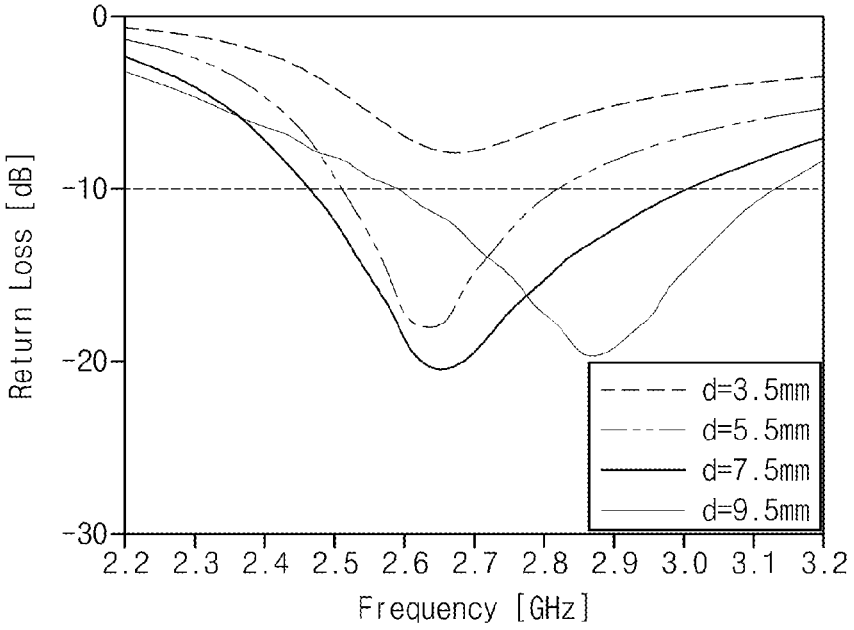
FIG. 7 is a graph showing reflection loss characteristics according the length of a microstrip line provided to a feeding line in a dual-polarized dipole antenna according to an embodiment of the present invention.

FIG. 7 is a graph showing reflection loss characteristics according to the size of a radiation patch in a dual-polarized dipole antenna according to an embodiment of the present invention. Referring to FIG. 7 and FIG. 3, it is shown that operating frequency is varied according to the length of d. In addition, the length of d influences a degree of antenna matching.

Figure 8:
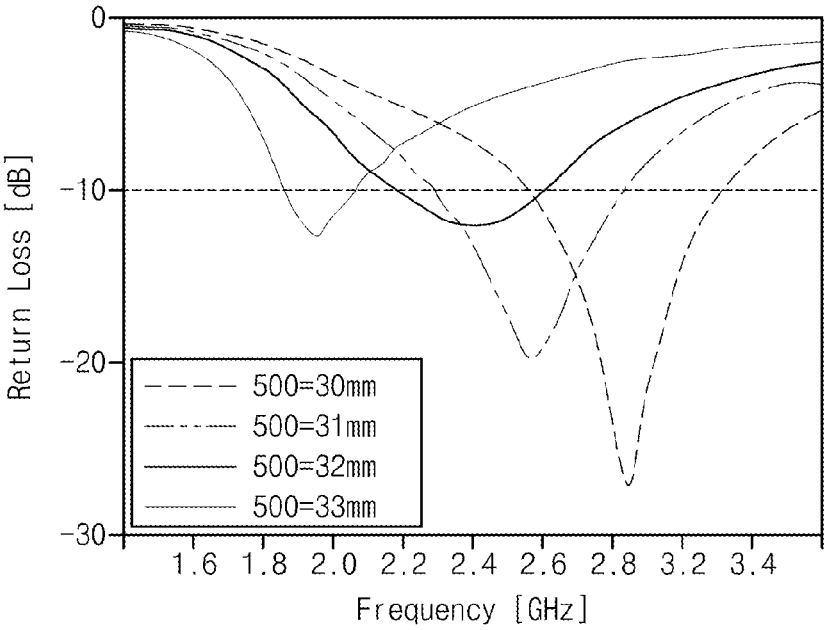
FIG. 8 is a graph showing reflection loss characteristics according to the size of a radiation patch in a dual-polarized dipole antenna according to an embodiment of the present invention.

FIG. 8 is a graph showing reflection loss characteristics according to the size of a radiation patch in a dual-polarized dipole antenna according to an embodiment of the present invention. It is shown that a band of operation frequency is varied according to the length of a side of the radiation patches 500*a* to 500*d* (see FIG. 1).

A dual-polarized dipole antenna according to an embodiment of the present invention can be miniaturized by including two pairs of dipole antennas, each pair of which generate vertically and horizontally polarized waves, and allowing the dipole antennas to share radiation patches. In addition, since a wide bandwidth, high isolation characteristics, and a high gain can be obtained, the dual-polarized dipole antenna can be applied to all the frequencies currently used and also to a beyond 4th generation (B4G) system.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A dual-polarized dipole antenna comprising:

a substrate forming a face of a cube, and first and second microstrip lines etched on the substrate;

third to sixth microstrip lines etched on first to fourth square-shaped feeding units, respectively, and the first to fourth square-shaped feeding units extending vertically from the substrate; and first to fourth radiation patches disposed orthogonally to the first to fourth square-shaped feeding units, wherein each of the first to fourth radiation patches is disposed on a different adjacent pair of the first to fourth square-shaped feeding units.

2. The dual-polarized dipole antenna of claim 1, wherein the first microstrip line is etched from a first feed to a first feed point and to a third feed point opposite to the first feed point, and the second microstrip line is etched from a second feed to a second feed point and to a fourth feed point opposite to the second feed point.

3. The dual-polarized dipole antenna of claim 2, wherein the third to sixth microstrip lines etched in the first to fourth square-shaped feeding units are respectively connected to the first to fourth feed points.

4. The dual-polarized dipole antenna of claim of claim 3, wherein each of the first to fourth square-shaped feeding units has an open loop further comprising an opening allowing the first microstrip line or the second microstrip line to be passed, and each of the openings face the substrate.

5. The dual-polarized dipole antenna of claim 4, wherein the third to sixth microstrip lines are etched to extend from the first to fourth feeding points to respective termination points that terminate prior to abutting the substrate.

6. The dual-polarized dipole antenna of claim 5, wherein distances from the first feed to the first feed point, from the first feed to the third feed point, from the second feed to the second feed point, and from the second feed to the fourth feed point are identical.

7. The dual-polarized dipole antenna of claim 6, wherein a degree of matching is determined according to a length of the third to sixth microstrip lines.

8. The dual-polarized dipole antenna of claim 6, further comprising a plurality of metal short-circuit plates provided on both sides of each of the first to fourth square-shaped feeding units extending vertically from the substrate.

9. The dual-polarized dipole antenna of claim 8, wherein each of the metal short-circuit plates is connected to a ground surface disposed between the substrate and the cube through via holes formed in the substrate.

10. The dual-polarized dipole antenna of claim 9, wherein the first and second feeds are connected to subminiature version A (SMA) connectors through the via holes formed in the substrate.

11. The dual-polarized dipole antenna of claim 6, wherein the first to fourth square-shaped feeding units and the first to fourth radiation patches are disposed so as to be separated by a predetermined distance from each other.

12. The dual-polarized dipole antenna of claim 6, wherein the first to fourth radiation patches are a quadrilateral or circular shape.

13. The dual-polarized dipole antenna of claim 6, wherein the cube is a metal body of aluminum or copper.

14. The dual-polarized dipole antenna of claim 7, wherein the cube is a non-metal body of polycarbonate, acetal, plastic, silicon, or Teflon.

15. The dual-polarized dipole antenna of claim 14, wherein one side of the cube, which abuts onto the substrate, is a square whose one side length is a half or smaller than a wavelength corresponding to an operating frequency.

16. The dual-polarized dipole antenna of claim 1, wherein the third to sixth microstrip lines are etched at right angles on the first to fourth square-shaped feeding units.

* * * * *